United States Patent [19]

Carter et al.

[11] 4,361,426

[45] Nov. 30, 1982

[54] ANGULARLY GROOVED CORRUGATED FILL FOR WATER COOLING TOWER

[75] Inventors: Thomas P. Carter, Laurel; Robert E. Cates, Arnold; Richard H. Harrison, Jr., Columbia; Edward N. Schinner, Highland, all of Md.

[73] Assignee: Baltimore Aircoil Company, Inc., Jessup, Md.

[21] Appl. No.: 227,302

[22] Filed: Jan. 22, 1981

[51] Int. Cl.[3] ..... B01F 3/04

[52] U.S. Cl. ..... 55/257 PV; 55/257 R; 261/112; 261/DIG. 11; 428/182; 428/183

[58] Field of Search ..... 261/79 A, 112, DIG. 11; 428/182, 183; 55/257 PV, 257 R

[56] References Cited

U.S. PATENT DOCUMENTS

| | | | |
|---|---|---|---|
| 2,793,017 | 5/1957 | Lake | 261/112 |
| 3,415,502 | 12/1968 | Munters | 261/DIG. 11 |
| 3,500,615 | 3/1970 | Meek | 261/112 |
| 3,540,702 | 11/1970 | Uyama | 261/DIG. 11 |
| 3,599,943 | 8/1971 | Munters | 261/112 X |
| 3,618,778 | 11/1971 | Benton et al. | 261/112 X |
| 3,726,408 | 4/1973 | Gewiss | 428/182 X |
| 3,733,063 | 5/1973 | Loetel et al. | 261/112 |
| 3,929,435 | 12/1975 | Engalitcheff, Jr. | 261/DIG. 11 |
| 3,952,077 | 4/1976 | Wigley | 261/112 |
| 4,269,796 | 5/1981 | Glicksman et al. | 261/112 |

FOREIGN PATENT DOCUMENTS

| | | | |
|---|---|---|---|
| 684870 | 12/1939 | Fed. Rep. of Germany | 261/112 |
| 1939796 | 3/1970 | Fed. Rep. of Germany | 261/112 |
| 2810094 | 10/1978 | Fed. Rep. of Germany | 261/112 |

*Primary Examiner*—Richard L. Chiesa

*Attorney, Agent, or Firm*—Mario A. Monaco; Michael C. Sudol, Jr.

[57] ABSTRACT

This invention involves spaced, horizontally extending corrugations, spaced, vertically oriented film surface sheets. The surface of the fill is enhanced by molded-in angular grooves to define discrete water passageways and air turbulation ridges.

4 Claims, 4 Drawing Figures

ANGULARLY GROOVED CORRUGATED FILL FOR WATER COOLING TOWER

BACKGROUND OF THE INVENTION

This invention relates to an angularly grooved fill sheet particularly one having horizontally extending corrugations, spaced, vertically oriented sheets of fill material whose surface is enhanced by molded-in angular zigzag grooves. Typical zig zag fill units have been known from the prior art. U.S. Pat. No. 3,540,702 shows a type of ribbed or zigzag-shaped corrugations on a slightly bent fill sheet. U.S. Pat. No. 3,733,063 shows basic zigzag-ribbed fill units having the zigzag ribs on a basically flat vertical fill sheet. U.S. Pat. No. 2,793,017 shows perpendicular intercepting corrugations in a basic fill design. None of these prior art patents show applicant's particular type of fill herein claimed.

SUMMARY AND DETAILED DESCRIPTION OF THE INVENTION

This invention relates to angularly grooved fill, particularly fill which is spaced, horizontally-extending corrugated, and vertically oriented whose surface is enhanced by molded-in angular zigzag grooves. This fill is particularly useful in forced draft crossflow cooling towers, and it will be described in this context although those skilled in the art would realize that it could be used in induced draft crossflow cooling towers as well as other arrangements involving counterflow and parallel flow cooling towers.

It is an object of this invention to increase the exposed wetted surface area of the fill. Another object is to cause turbulation of air in the passageways between the fill. Yet another object is to direct water flow in a downward helical spiral pattern of multiple groove channels to increase air and water contact time. Another object is to direct airflow in specific upward and downwardly angular vectors in each air passageway thus promoting a general rolling motion of air in addition to turbulation of water in the narrowest gap of the crescent-shaped air passageways. The purpose of the above mentioned objects is to increase air and water contact time and thereby increase thermal performance capability.

Another object is to provide improved vertical structural rigidity of the fill sheet and improved resistance to plastic creep deformation to maximize fill useful life. A further object is to have both sides of the fill sheet wetted equally from a horizontal plan spray array. Another object is to provide for vertically oriented, deep, corrugated drift eliminators integrally connected with the primary fill sheet. Another prime object of this invention is to provide maximum cooling of water for minimum amount of air passing through, thereby consuming minimum fan power.

In order to better describe this invention references herein are made to the following drawings which accompany this patent application in which.

Figure 1:
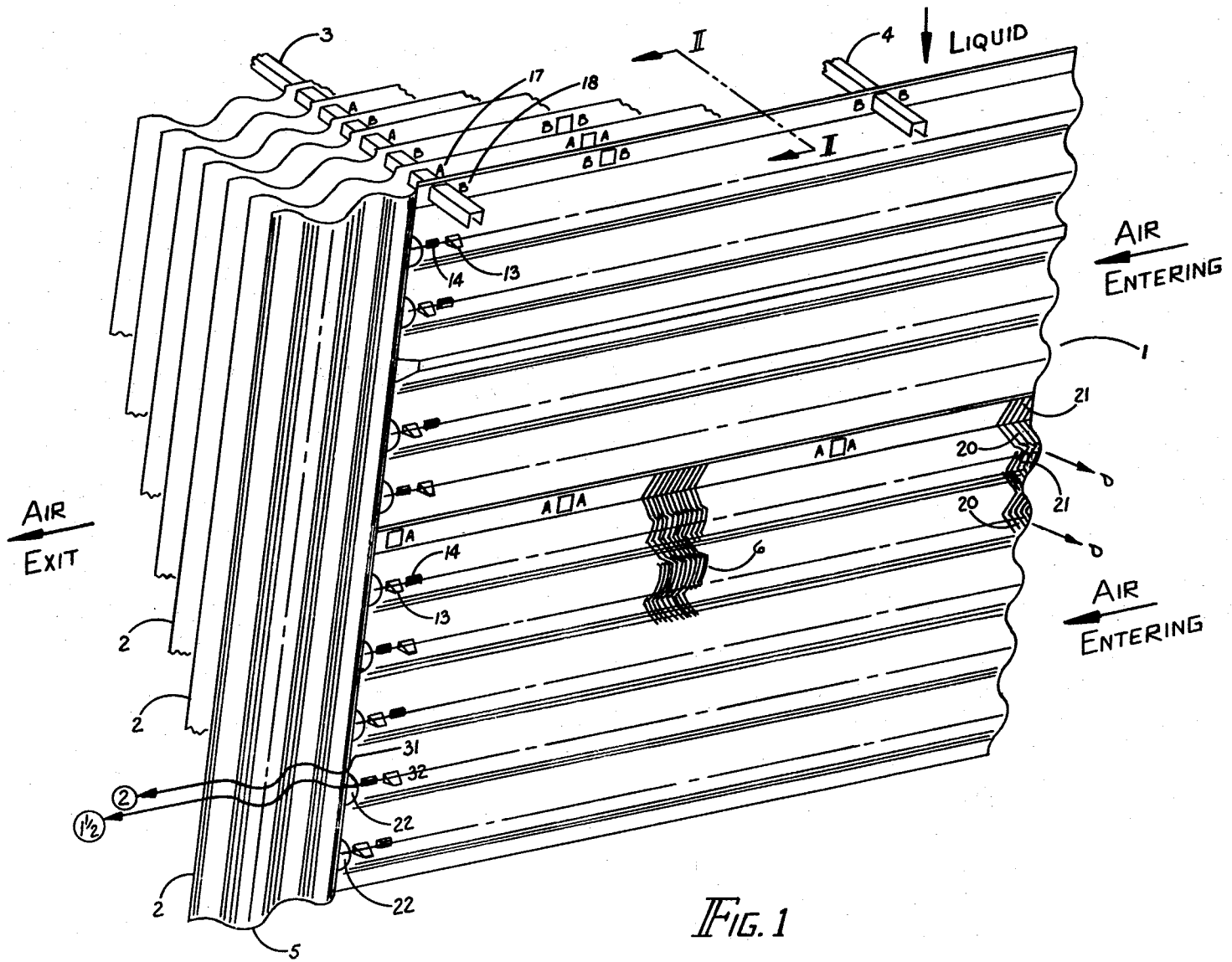
FIG. 1 shows an isometric view cut away of a typical fill pack of the invention, as it is utilized in a crossflow cooling tower.
Figure 2:
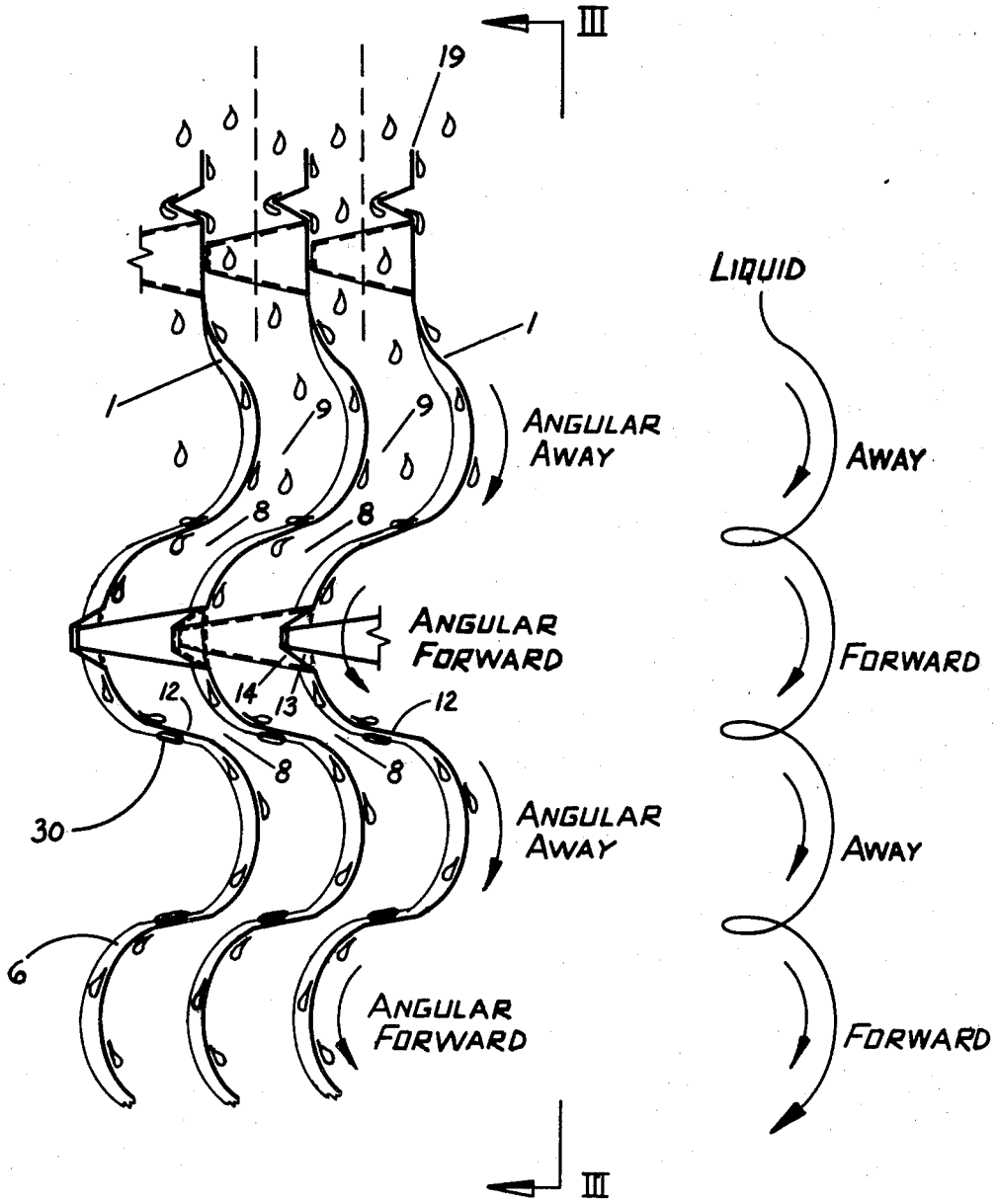
FIG. 2 shows a cross-section cut along line II—II of FIG. 1.
Figure 3:
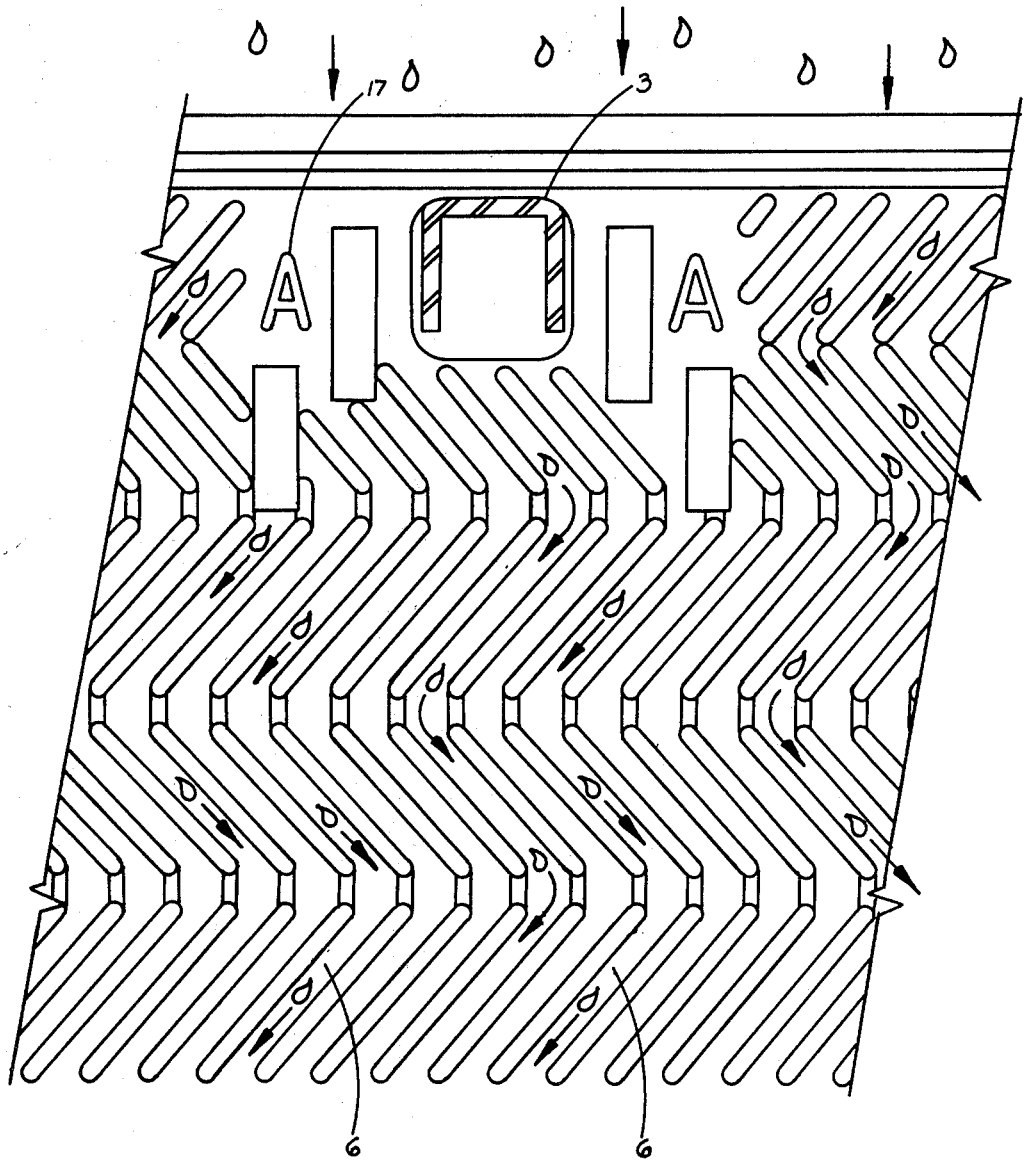
FIG. 3 shows a side view of the top portion of the fill sheets of our invention taken along line III—III of FIG. 2.
Figure 4:
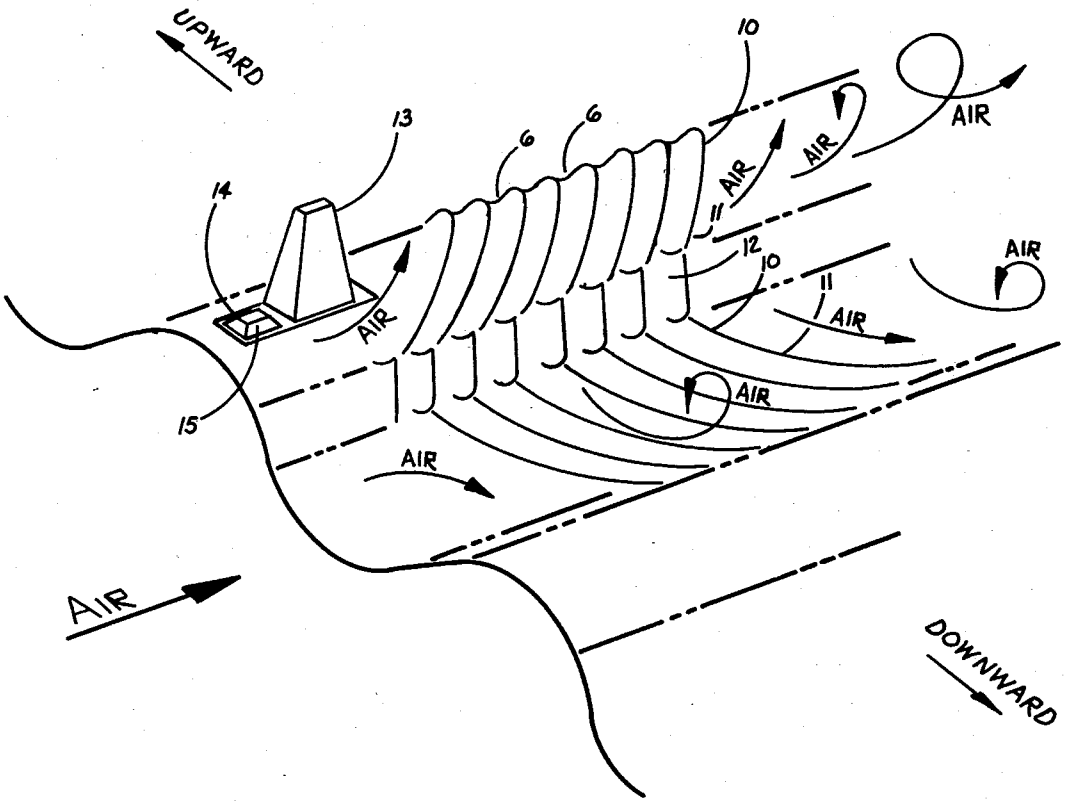
FIG. 4 represents an isometric view toward the edge of a typical fill sheet of our invention.

Referring now to FIG. 1, it can be seen that air enters the cooling tower fill pack 1 comprising fill sheets 2 which are hung or suspended by support channels 3 and 4. The air flows through the fill pack 1 between adjacent fill sheets 2 and exits on the left end of the fill pack after finally passing through the eliminator portion 5. Water is distributed cross the top of the fill pack 1 and falls downward through the fill, is cooled by sensible and latent heat transfer by contact with an air stream passing perpendicularly through the fill and falls to a sump area below the fill wherein the cooled water is collected and used for the basic heat transfer process in which cooling is required.

As can be seen from any of the figures 1 through 4, the fill includes typically sinusoidal type corrugated sheets 2 nestled together hvaing angular grooves 6 therein. These grooves serve a number of purposes, namely to increase heat transfer and expose wetted surface area, to turbulate the air in the passageways, to direct water flow in a specific downward helical spiral pattern (See FIG. 2) of multiple groove channels 6, to direct airflow in specific upward and downwardly angular vectors (See FIG. 4) in each passageway promoting a general rolling motion of air in addition to a turbulation of water in the narrowest gaps 8 of FIG. 2 of the crescent-shaped air passageways, to increase the residence time of the water as it passes down the full fill sheet height and to provide vertically structural rigidity and resistance to plastic creep formation, all of which enhance the basic heat transfer capability of the fill pack assembly 1.

The downward helical-spiral water path (FIG. 2) increases "hang-time" or exposure time of water in the air passageways 9. This process or "time-spiral" innovation improves heat transfer, making colder water in the most compact fill pack assembly possible. This time-spiral concept is a prime distinguishing feature over the prior art in that combining the spiral path for the water on a generally corrugated sheets with near-horizontal pockets 12 of FIG. 4 allows for a much greater air-water contact time than that possible with the generally vertical fill of the prior art.

The enhancement grooves 6 shown as constant depth may also be variable in depth to permit ease of releasing the sheet from the mold during the vacuum forming process. Thus the deepest part 10 of grooves 6 compare oppositely to shallower parts on alternate corrugations. The grooves of all corrugations have full continuity of groove passage to conduct water travel in specific grooves from top to bottom of the fill sheets continuously.

Specific shape and angularity of the corrugations is designed to retain water on the sheet and prevent migration to adjacent sheets. The near-horizontal "pocket" grooves 12 should be disposed angular with respect to the horizontal between the limits of 5° and 60° (preferably about 15°) to assure water retention and avoid the possibility that water droplets may fall from the bottom surface groove 30 into the free air space of the crescent air passageway 9. No horizontal water channel elements of surface exist in the corrugation pattern. However, the near horizontal pocket grooves 12 on FIGS. 2 and 4 function as pockets to hold water for the longest possible contact time with air currents, during the downward travel sequence of elemental cooling.

The primary purpose of the male space knob 13 and the female seat space knob 14 (FIGS. 2 and 4) design is to maintain a general spaced relationship of adjacent corrugated, grooved fill sheets. A further purpose of the knob and seat design is to minimize airflow passageway air resistance. A further purpose of spacer knob design is to allow full nesting of sheets during handling or storage prior to assembly.

Spacer knobs 13 and seats 14 are aligned closely together, preferably from about ½" to 1½" apart or 12.7 mm to 38.1 mm apart. This spacer knob design also minimizes rocking or snaking of horizontal corrugations to improve the packing integrity and assure proper spacing when tightly encasing the fill packs within the casing box.

Spacer knob seats 14 have angular entry sides 15 to guide the knobs 3 to the most precise final resting positions. Seats 14 provide shelf-like support elements for adjacent sheet knobs (See FIGS. 2).

Note that embossed letter A on the top of Sheet 17 of FIG. 1 is adjacent sheet 18 with embossed letter B at its top. Also note that the lower half of sheet 18 has embossed letter A. From this it can be noted that all knobs and seat spacers 13 and 14 are located in opposed positions for sheet positions A and B respectively. It can now be readily seen that a sheet with top edges embossed with B adjacent a sheet embossed A will cause the knob 13 to nestle in the seat 14 inherently. Therefore, it is essential that fill sheets with top edge embossments A must be located between fill sheets top edge marked B, respectively.

This method of molded sheet design can permit making continuous sheets of any height of increments of fill mold half-height merely by continuing the transport of the formable sheet feedstock through the forming apparatus on a continuous basis.

The top edge 19 of the sheets (FIG. 2) are spaced apart from each other near the mid-point of the corrugation curve to assure wetting both sides of corrugated sheets equally.

The air inlet edge of fill is enhanced with the same zigzag grooves as in main body of fill. Grooves 20 of FIG. 1 direct specific streams or droplets of water away from the sheets while grooves 21 alternately direct water streams back into the fill region. This alternate grooving is necessary for structural continuity and other previously described purposes.

Attached integrated vertical deep-multiple-groove corrugated drift eliminator 5 of FIG. 1 are molded simultaneously with the primary fill sheet and are connected via a "transition" 22 of molded fill sheet. The transition section also performs some drift elimination and thermal performance function, while redirecting the air from the corrugated fill section smoothly to the vertical eliminator air passageways. The vertical integrated eliminator also provides improved vertical structural stability to resist plastic creep deformation and sag.

The said transition section 22 is arranged to provide a 2-wave drift eliminator interface with the air which is transported through the alternate corrugation air passageways 31 and provide inherently a 1½-wave drift eliminator interface with the air being transported through the alternate corrugation air passageways 32 to permit balancing the air velocity between the more restrictive knob-spacer corrugation elements 32 and the adjacent corrugation elements 31 which employ no spacer knobs. This also assures adequate drift elimination for the somewhat higher velocity air currents which pass through the corrugations 31 that employ no spacer knobs.

The particular fill of this invention has its main use in forced-draft (blow-through) cooling towers, but is not limited thereto, and can also be employed for use in induced-draft (draw-through) cooling towers as well as other types.

The entire fill structure herein above described precludes the need for louvers at the air entering face of the fill pack thereby providing greater airflow volume, having no elements of air resistance normally due to the louver section of conventional induced-draft (draw-through) towers, as well as providing a convenient means to purposely direct water streams and droplets into the turbulent fan discharge or plenum chamber when used in a forced-draft tower arrangement.

The feedstock material from which the fill pack sheets are formed may be of any formable sheet material, such as PVC (polyvinyl chloride), aluminum, steel, or other formable metals. However, the preferred material should be non-corrodable in nature to withstand the hot, wet, humid operating conditions.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. A fill sheet of formable material having therein horizontal sinusoidal corrugations with angular grooves of variable depth with a generally zigzag spiral pattern throughout with nearly horizontal water cooling pockets an angle of about 15° to the horizontal at the sinusoidal point of inflection between each corrugation, having a pair of opposed sides adapted for coverage by heated water flowing thereover and having an integrally-formed near-vertically corrugated mist eliminator at an air exit end of said sheet.

2. A fill unit for packing use in a water-cooling tower said unit comprising normally upright sheets of formable material with each sheet having horizontal sinusoidal corrugations with angular grooves of variable depth with a generally zigzag downward spiral pattern throughout, each sheet having a pair of opposed sides adapted for coverage by heated water flowing downwardly thereover and having nearly horizontal, water-cooling pockets at an angle of about 15° to the horizontal at the sinusoidal point of inflection between each corrugation and each sheet having an integrally-formed near-vertically corrugated mist eliminator at an air exit end of said fill unit.

3. The fill unit of claim 1 wherein the grooves are oriented angularly upward or downward within each alternate corrugation.

4. The fill unit of claim 1 wherein half the grooves at the air entering side are formed with generally downward angular vectors.

* * * * *